United States Patent [19]

Boutet

[11] 4,274,221

[45] Jun. 23, 1981

[54] TOY BUILDING BLOCK

[76] Inventor: Gilles Boutet, 5127 Royale Ave., Boischatel, Canada, GOA 1HO

[21] Appl. No.: 103,054

[22] Filed: Dec. 13, 1979

[51] Int. Cl.[3] ..... A63H 33/06

[52] U.S. Cl. ..... 46/25

[58] Field of Search ..... 46/16, 17, 23, 24, 25, 46/26; 273/160; D21/104, 107, 108; 52/608, 609

[56] References Cited

U.S. PATENT DOCUMENTS

| | | | |
|---|---|---|---|
| D. 206,336 | 11/1966 | Wilson | D21/107 |
| 2,100,658 | 11/1937 | Finch | 46/26 |
| 2,939,243 | 6/1960 | Duggar | 46/24 |
| 3,065,970 | 11/1962 | Besley | 273/160 |
| 3,672,110 | 6/1972 | Nordstrom | 52/608 |
| 3,672,681 | 6/1972 | Wolf | 46/26 X |
| 3,813,841 | 6/1974 | Tsurumi | 46/24 X |
| 3,854,237 | 12/1974 | Loth | 46/26 |
| 4,197,669 | 8/1977 | Hynes | 46/25 |

FOREIGN PATENT DOCUMENTS

| | | | |
|---|---|---|---|
| 1265638 | 4/1968 | Fed. Rep. of Germany | 46/25 |
| 2307241 | 2/1973 | Fed. Rep. of Germany | 46/25 |
| 614100 | 9/1926 | France | 52/609 |

*Primary Examiner*—F. Barry Shay

[57] ABSTRACT

Each block of a set of toy building blocks is in the shape of a cube with two in-formed recesses, one at one corner of the cube and the other in the diagonally opposed corner. The dimensions of both recesses are equal and cubic, and equivalent to half the length of one of the sides of the cube.

1 Claim, 4 Drawing Figures

TOY BUILDING BLOCK

FIELD OF THE INVENTION

This invention relates to a set of modular design blocks, specifically to a set of blocks of novel construction which may be assembled together to make a multiplicity of different patterns or architectural shapes.

BACKGROUND OF THE INVENTION

Several types of building blocks for use by children have already been proposed. For example, U.S. Pat. No. 3,854,237 shows a block having light sides including a half cube section and dowels to secure the blocks together. This block, although interesting, is probably not suitable for very young children who are just beginning to develop motor coordination: they would most likely be frustrated in trying to put the dowels into their respective holes. Also, the block does not have a balanced shape.

OBJECTS OF THE INVENTION

Accordingly, it is an object of the present invention to provide toy building blocks which may be used by any child.

It is another object of the present invention to provide a set of toy building blocks which may be assembled and taken apart with ease and which are strong and inexpensive to manufacture without limitation as to the material used to fabricate the blocks.

SUMMARY OF THE INVENTION

Each block of the set herein disclosed is identical and generally cube shaped. At the opposite ends of one of the diagonals of the cube, a cubic recess having sides equal to half the dimension of the cube is formed giving all six sides of the cube an L-shaped configuration.

The above will be more clearly understood by referring to the preferred embodiment of the invention, illustrated by way of the accompanying drawings, in which:

BRIEF DESCRIPTION OF THE DRAWINGS

Like numerals refer to like elements throughout the drawings.

DETAILED DESCRIPTION OF THE INVENTION

Figure 1:
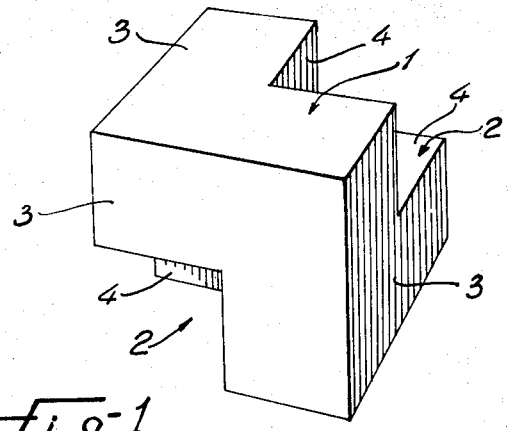
FIG. 1 is a perspective view of the block.

Block 1 as shown in FIG. 1 is generally in the shape of a cube having sides at right angles to each other and of the same dimension.

At both ends of one of the diagonals of block 1 are two identical recesses 2 which are also cubic in shape. These recesses 2 have equal dimensions which are equal in turn to half the length of one of the sides of the block 1. Thus the sides 3 of block 1 have an L-shaped flat plane configuration and walls 4 of each recess gives the block a total of twelve sides. Block 1 is a polyhedral.

Figure 2:
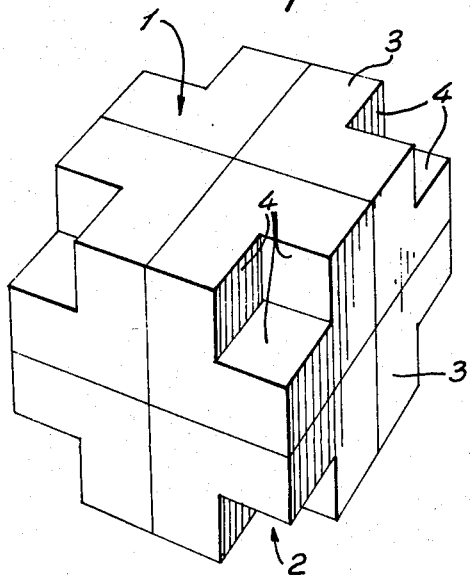
FIG. 2 is a perspective view of a symmetrical shape using eight of the blocks.

FIG. 2 shows a symmetrical architectural figure using eight of the blocks 1.

Figure 3:
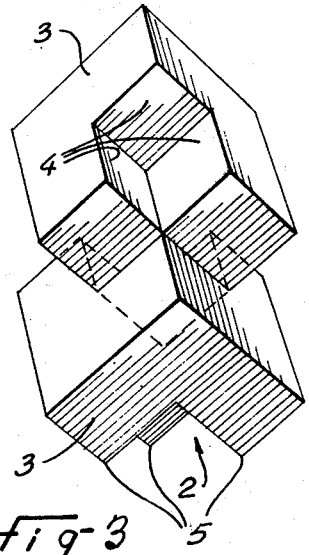
FIG. 3 is a perspective view of two blocks assembled together.

FIG. 3 suggests how a tower might be built of blocks 1. The lower block rests on the three corners 5 of one of its recesses 2 and is stable since each corner 5 is midway of the length of its two corresponding faces or sides 3. The upper block 1 is reversed and a corner rests in the other upwardly facing recess 2 of the lower block. Obviously more blocks might be stacked by repeating the above arrangement.

Figure 4:
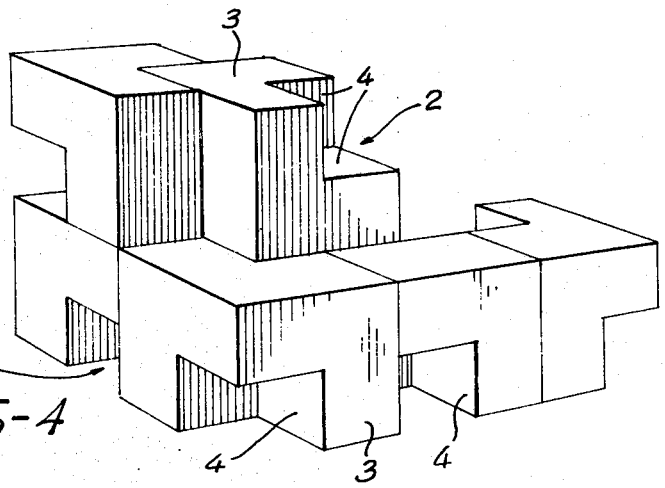
FIG. 4 is a perspective view of several blocks assembled together in another architectural shape.

In FIG. 4 is shown another architectural shape, one of many limitless arrangements for the creative enjoyment of a child playing with blocks 1.

What I claim is:

1. A set of toy building blocks, each block of the set being identical as to size and shape, each block consisting of a single piece in the shape of a cube having two cubic shaped recesses located in two diagonally opposite corners of said block respectively, the remaining six corners of said cube being free of any such recess, each recess having three square faces each parallel to a side of said cube, said faces being equal in dimension and devoid of connecting means, and wherein said dimension is one-half the length of a side of said block, each of said faces and sides being uninterruptedly planar.

* * * * *

UNITED STATES PATENT AND TRADEMARK OFFICE

CERTIFICATE OF CORRECTION

PATENT NO. : 4,274,221

DATED : June 23, 1981

INVENTOR(S) : Gilbert Boutet

It is certified that error appears in the above—identified patent and that said Letters Patent is hereby corrected as shown below:

On The Title Page The Inventor's name should read

-- Gilbert Boutet --.

Signed and Sealed this

Tenth Day of November 1981

[SEAL]

Attest:

GERALD J. MOSSINGHOFF

Attesting Officer

Commissioner of Patents and Trademarks